United States Patent [19]

Aoki et al.

[11] Patent Number: 4,504,137

[45] Date of Patent: Mar. 12, 1985

[54] APPARATUS FOR COLOR ELECTROPHOTOGRAPHY

[75] Inventors: Takao Aoki, Abiko; Hidejiro Kadowaki, Yokohama; Naoki Iwami, Tokyo, all of Japan

[73] Assignee: Canon Kabushiki Kaisha, Tokyo, Japan

[21] Appl. No.: 426,080

[22] Filed: Sep. 28, 1982

Related U.S. Application Data

[60] Continuation of Ser. No. 149,431, May 13, 1980, abandoned, which is a division of Ser. No. 914,729, Jun. 12, 1978, Pat. No. 4,230,783.

[30] Foreign Application Priority Data

Jun. 17, 1977 [JP] Japan ..... 52-71901

[51] Int. Cl.[3] ..... G03G 15/01

[52] U.S. Cl. ..... 355/4; 355/3 R

[58] Field of Search ..... 355/4, 3 R, 3 CH, 14 E, 355/14 CH, 71; 430/42, 46, 55, 902

[56] References Cited

U.S. PATENT DOCUMENTS

| | | | |
|---|---|---|---|
| 4,077,709 | 3/1978 | Borostyan et al. | 355/3 R |
| 4,095,888 | 6/1978 | Kawazu et al. | 355/4 |
| 4,165,165 | 8/1979 | Iwami et al. | 355/4 |
| 4,170,413 | 10/1979 | Bayer | 355/3 R |
| 4,262,075 | 4/1981 | Noda et al. | 355/3 CH |

FOREIGN PATENT DOCUMENTS

| | | | |
|---|---|---|---|
| 107938 | 8/1975 | Japan | 430/42 |

*Primary Examiner*—R. L. Moses

*Attorney, Agent, or Firm*—Fitzpatrick, Cella, Harper & Scinto

[57] ABSTRACT

An electrophotographic apparatus for forming color images has a photosensitive member, a charging device for applying a primary charge, an imaging device for selectively exposing the photosensitive member to image light of different color components and a device for uniformly exposing the photosensitive member to near infrared light substantially simultaneously with the image exposure. Different color images are sequentially formed, developed and transferred to a transfer material to form a resultant color image with good color balance.

15 Claims, 8 Drawing Figures

APPARATUS FOR COLOR ELECTROPHOTOGRAPHY

This is a continuation of application Ser. No. 149,431, filed May 13, 1980 (now abandoned), which in turn is a division of Ser. No. 914,729, filed June 12, 1978 (patented) No. 4,230,783.

BACKGROUND OF THE INVENTION

1. Field of the Invention

The present invention relates to process and apparatus for electrophotography and more particularly relates to electrophotographic process and apparatus which improves the gradation (gradient) of electrostatic latent image and allows a color reproduction with improved color balance.

2. Description of the Prior Art

In the art of electrophotography, there have been made remarkable developments and improvements starting from the so-called Carlson Process in which an electrostatic latent image is formed on the surface of a photoconductive layer and then the formed latent image is developed for further use. As one of the important developments in this technical field, such electrophotographic process has been proposed and practically accepted in which a photosensitive medium having an insulating layer overlaid on a photoconductive layer is used and an electrostatic latent image is formed on the insulating layer. The latent image thus formed on the insulating layer is very stable against light.

Examples of such improved electrophotographic process are disclosed in U.S. Pat. No. 3,666,363 (GP 1,522,568), U.S. Pat. No. 3,734,609 and U.S. Pat. No. 4,071,361 all of which were proposed in behalf of the assignee of the present application. These processes employ the above mentioned multi-layer photosensitive medium and give particularly good electrostatic latent images of high stability and high contrast.

The photosensitive medium used in these electrophotographic process is formed by applying a photoconductive layer and a light transmissive dielectric layer on a support of electrically conductive or insulating material. In a dark place or in a light place, the photosensitive medium is charged with a corona discharge so that electric charges may be trapped in the interface between the photoconductive layer and the light transmissive insulating layer or in its neighbouring area. Then, a light image is projected onto the surface of the photosensitive medium while applying to it a corona discharge of the opposite polarity to that of the firstly applied corona discharge or an alternating corona discharge. This secondary corona discharge is followed by a whole surface exposure of the photosensitive medium so that making use of difference in impedance of the photosensitive medium between the dark and the light, the electric charge on the light part may be reversed or cancelled out. In this manner, a latent image is formed which has a contrast in electrostatic potential. The latent image thus formed is developed and transferred in the conventional manner to make a photoprint. In case of color reproduction, individual elemental color images of the color original are produced by known color separation technique and they are overlaid on each other to form an overlaid color print. More particularly, this color electrophotographic process involves the following steps:

Initially, the photosensitive medium is charged by corona discharge. Then, a light image of a color original is projected onto the photosensitive medium through a color filter in one of three primary colors of additive color process, for example, through a blue color filter while effecting corona discharging with the opposite polarity or with alternating current. Thereafter, the photosensitive medium is subjected to a whole surface exposure so as to form an electrostatic latent image thereon. The latent image thus formed is developed with color toner whose color is one of the three primary colors of subtractive color process and also complementary color to the color of color filter used, namely, in this case with yellow toner. The developed image is transferred onto a suitable support such as a sheet of paper. In this manner, at first there is formed an elemental color image of blue component of the color original.

In the same manner, a green component image is formed using a green filter for exposure and magenta toner for development. The green component image developed in magenta is properly registered with the firstly formed blue component image developed in yellow and the former is overlaid on the latter by overlapping transference.

Lastly, a red component image is formed in the same manner using a red filter for exposure and a cyanic toner for development. The red component image developed in cyan is registered with and transferred onto the above component image developed in magenta so that an overlaid color print is finally produced.

If necessary, so-called black print may be overlaid further onto the color print to improve the quality of the formed color image. For this purpose, a latent image is formed using a ND filter and then developed with black toner. The developed image is registered with the color print and transferred by overlapping transference.

In this manner, monochromatic image or multicolored image corresponding to the original is obtained using this electrophotographic process. The electrostatic latent image formed in this process is featured by its higher contrast as compared with other known processes. In general, the higher the contrast is, the more easy reproduction of gradation is allowed in this process. However, it is still a difficult problem to reproduce the gradation by a satisfactory degree.

This problem of gradient will be understood from the characteristic curve of latent image potential (V)—exposure (E) shown in FIG. 1.

FIG. 1 shows the characteristic curves of individual color component images in three-color separation obtained in the above described color reproduction. The degree of gradation of image is represented as the gradient of the curve and it is generally called "$\tau$ value". This $\tau$ value is very difficult to control. For example, in the above described process there was never obtained any satisfactory result even when potential of corona discharge and amount of exposure were variously controlled. Particularly in color reproduction, this difficulty of control or $\tau$ value brings forth a particular important problem against good image reproduction. As well-known in the art, in color reproduction there is allowed to obtain an image of good color balance only when the conformity in gradient ($\tau$ value) of all the three elemental color images is attained. But, in practice, as seen best in FIG. 1, three individual color component images formed on the photosensitive medium are generally different from each other in $\tau$ value.

As will be understood from FIG. 1, the characteristic curve (B) obtained at the time of blue exposure has such tendency that the potential at the light portion and its neighbouring portion becomes higher. Characteristic curve (G) of green exposure exhibits somewhat similar tendency. For this reason, these two curves are out of balance relative to the characteristic curve (R) of exposure in red color. As a result, final $\tau$ values of three color component images in image density—original density curves become different from each other and therefore no good balance in color can be obtained. The component image exposed to blue light and developed in yellow is apt to suffer from fogging. All the attempts to true up the three characteristic curves of latent image potential (V)—exposure (log E) in three-color separation exposure have resulted in failure. Even when the potentials of the primary charging, of the secondary charging with the opposite polarity or of AC discharging or the value of exposure in color separation were variously changed, there could be obtained no satisfactory result.

SUMMARY OF THE INVENTION

Accordingly, it is an object of the present invention to provide electrophotographic process and apparatus which satisfactorily controls the $\tau$ value of an electrostatic latent image formed on the photosensitive medium.

It is another object of the invention to provide an electrophotographic process and apparatus which satisfactorily control the color balance in color reproduction.

It is a further object of the invention to provide electrophotographic process and apparatus which controls the $\tau$ value of an electrostatic latent image while maintaining the latent image forming process in good condition.

A still further object of the invention is to provide an electrophotographic apparatus which is simple in structure and which controls the $\tau$ value of latent image.

To attain the above and other objects according to the invention, the photosensitive medium is exposed to light in the near infrared range almost simultaneously with image-wise exposure in forming an electrostatic latent image on the photosensitive medium.

Other and further object, features and advantages of the present invention will appear more fully from the following description taken in connection with the accompanying drawings.

DESCRIPTION OF THE PREFERRED EMBODIMENTS

The principle of the electrophotographic process according to the invention is described in detail with reference to FIG. 2.

Figure 2A:
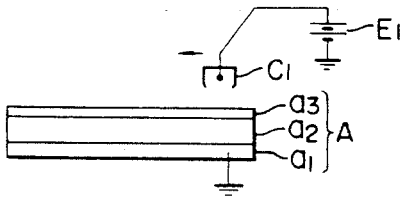
FIG. 2 schematically shows the steps involved in forming a latent image according to the invention wherein (a) is primary charging step, (b) is step of discharging or charging with the opposite polarity simultaneous with image-wise exposure and (c) is the whole surface exposure step.
Figure 2B:
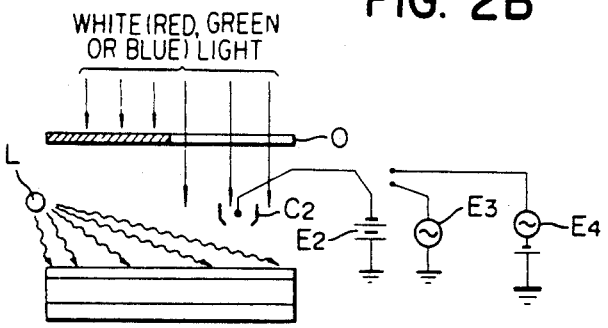
Figure 2C:
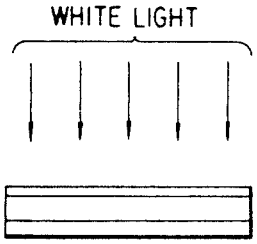

In FIG. 2, A designates a photosensitive medium the basic structure of which comprises an electrically conductive base plate $a_1$, a photoconductive layer $a_2$ applied on the base plate and an insulating layer $a_3$ overlaid on the photoconductive layer.

The photoconductive layer $a_2$ is formed by vapour-depositing or spraying a suitable photoconductive material on the electrically conductive layer $a_1$ or coating the material on it with a coater or a faller. As the photoconductive material, there may be used CdS, CdSe, crystalline Se, ZnO, ZnS, $TiO_2$, Se-Te and PbO of mixture thereof and also photoconductive substance of low resistance. Dye, pigment or the like may be added as sensitizer.

When the above mentioned photoconductive material is used in a form of dispersion in binder resin, acrylic resin, epoxy resin, vinyl resin, silicone resin, alkid resin or polyester resin is preferably used as the binder resin. Other resins conventionally used in the art of electro-FAX as binder also may be used.

The insulating layer $a_3$ is formed by using such material that satisfies the requirements of high abrasion resistance, electrostatic charge retentivity with high resistance and transmissivity of radiation rays to which the photoconductive layer is sensitive. Examples of such material include fluoro resin, polycarbonate resin, polyethylene resin, cellulose acetate resin, polyester resin and the like.

On the surface of the above described photosensitive medium, there is formed on electrostatic latent image by the following three steps (a)-(c):

At the step (a), the surface of the insulating layer $a_3$ of the photosensitive medium is subjected to the action of corona discharge of a given polarity by a corona discharger $c_1$. The voltage applied to the corona discharger from a power source $E_1$ is suitably selected depending upon the kind of photoconductive material used for the photoconductive layer $a_2$. For example, when as the photoconductive material for the layer $a_2$, CdS that is of N-type photoconductivity is selected, positive (+) voltage must be applied so as to inject electric charges into the interface between the insulating layer $a_3$ and the photoconductive layer $a_2$. But, this is not applicable to the case wherein a barrier layer for preventing charge injection is provided between the conductive layer $a_1$ and the photoconductive layer $a_2$.

At the next step (b), an image-wise exposure of an original O is effected on the photosensitive medium A the surface of which has been charged uniformly at the step (a). During the image-wise exposure, a secondary corona discharge with the opposite polarity to that of the charge previously applied to the surface of the photosensitive medium is applied to it by a second corona discharger $C_2$. As the voltage source for the corona discharger $C_2$ there is used a DC power source $E_2$ the polarity of which is opposite to that of the firstly applied charge, an AC power source $E_3$ or an asymmetrical AC power source biased to the opposite polarity.

Simultaneously with the image-wise exposure and corona discharging with the opposite polarity, the photosensitive medium surface is exposed to near infrared light rays emitted from a light source L.

Lastly, at the step (c), the photosensitive medium surface is subjected to a whole surface exposure with white light. In this manner on electrostatic latent image is formed on the photosensitive medium A.

Generally all of light rays having a wavelength above 700 nm (including not only visible range rays but also infrared rays) may be used in the invention as the near infrared light. Preferably, such range of wavelength is used which is above the spectrosensitivity range of the photosensitive medium, in particular to which the photosensitive medium, is essentially insensitive. In the shown apparatus for carrying out the process of the invention, it is desired that the minimum wavelength of the light from the near infrared light source is limited to about 600 nm, although light including visible range rays may practically be used.

According to the above described process of the invention, there is formed on the photosensitive medium an electrostatic latent image the $\tau$ value of which is well controlled. This effect of the present invention is used most advantageously in color reproduction. For color reproduction, the above described electrostatic latent image forming process is repeatedly carried out in color separation to form individual color component images which are developed with the corresponding color toners respectively. Developed individual color component images are transferred onto a transfer sheet in a correctly registered and overlapped relation to produce a complete color image.

According to the invention, there is obtained a good balance in color between the individual electrostatic latent images formed in color separation. This is seen in FIG. 3 showing characteristic curves of latent image potential (V)—exposure (log E) of the individual electrostatic latent images in three-color separation formed by the above described process of the invention.

Figure 1:
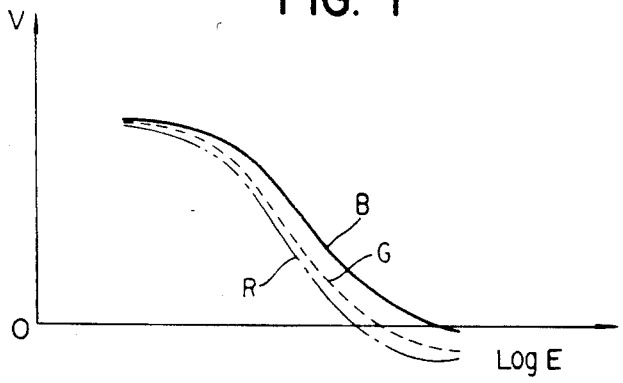
FIG. 1 shows latent image potential (V)—exposure (log E) characteristic curves obtained when three color component images of a color original were formed on a photosensitive medium according to the prior art process.
Figure 3:
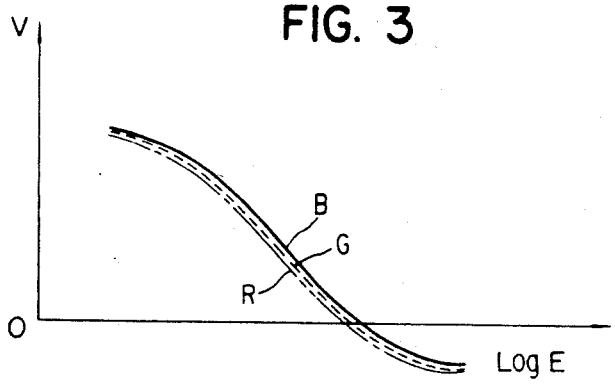
FIG. 3 shows latent image potential (V)—exposure (log E) characteristic curves obtained when three color component images of a color original were formed on a photosensitive medium according to the process of the invention.

It is obvious from FIG. 3 that the characteristic curve (B) of the electrostatic latent image of blue color component formed according to the invention exhibits a greatly reduced potential at its light portion as compared with that of the prior art shown in FIG. 1 where no near infrared exposure was effected in forming the individual color separated latent images. As to the characteristic curve of green color component latent image (G) as well as that of red color component latent image (R), the potential at the light portion can be reduced as desired. In this manner, according to the invention, a conformity of all three latent image characteristics of B, G and R is attainable. In this respect, it should be noted that the reduction of potential found in the characteristic curves of B, G, R is slight in the darkest portion and large in the portion between the dark part and the light part. As a result, in the B, G, R characteristic curves obtained according to the invention there no longer appears any shoulder portion intermediate between the dark portion and the light portion as seen in those of FIG. 1. Accordingly, the linearity of B, G, R characteristic curves is substantially improved and a broader response range of potential to exposure is obtained.

The reason why such advantageous effects are attained according to the invention may be considered as follows:

In forming each the electrostatic latent image, electric charges are injected through the electrically conductive base plate at the step of primary charging and the injected charges are trapped in the interface between the insulating layer and the photoconductive layer after passing through the latter. But, at this time, a portion of the charges can not reach the interface and remain trapped at the trap energy level in the photoconductive layer. Therefore, at the step of secondary charging with the opposite polarity or AC discharging simultaneous with image-wise exposure, the exposure light of short wavelength, in particular the exposure light in blue is absorbed solely by the surface of the photoconductive layer. As a result, while the electric charges trapped in the interface between the insulating layer and the photoconductive layer at the light part may be released from trapping, other charges trapped within the photoconductive layer remain unreleased which produces a residual potential. In case of red light exposure, the light can enter the interior of the photoconductive layer so that charges trapped therein may be released resulting in no or very small residual potential. The phenomenon occurred at the time of green light exposure is intermediate between that in blue light exposure and that in red light exposure and therefore some residual potential may be produced. In this manner, the depth of light absorption by the photoconductive layer varies depending upon the wavelength of light used for image-wise exposure. This may be explained from the following known facts:

According to Rayleigh's equation of light scattering, the scatter of light caused by a photoconductive substance dispersed in a binder resin used for forming the photoconductive layer is reciprocally proportional to the fourth power of the wavelength of light.

Photoconductive material has its own color (for example, CdS is yellow) which gives rise to a difference in ight absorption depending upon the difference of wavelength.

The uniform exposure with light containing near infrared rays carried out every time of color separation exposure according to the invention has such effect that electric charges trapped within the photoconductive layer which can not be released only by the color separation exposure are released from trapping. Thereby, the difference in latent image potential characteristics otherwise existing between three color component images becomes almost disappeared. This effect of uniform exposure with near infrared rays is most remarkable for blue light exposure and the effect becomes smaller and smaller for green and for red in this order.

The reduction of latent image potential resulted from the uniform exposure with weak light containing near infrared rays according to the invention is small in the dark portion of color separation image-wise exposure and large in the intermediate portion between the dark and the light. It may be said that this is because the energy necessary to release charges trapped within the photoconductive layer contributive to the formation of residual potential is larger than that necessary to release charges trapped in the interface between the insulating layer and the photoconductive layer.

Compared with the dark side, the light side accepts a larger quantity of light and moreover the near infrared light accelerates the release of charges from trapping in depth. These combined actions of light serve to effectively release the trapped charges.

At the time of color separation exposure, some of charges trapped in the interface between the insulating layer and the photoconductive layer will be released also at the dark side. But, these released charges at the dark side may be trapped at the vacancy level of trap energy produced by the uniform exposure with near infrared light within the photoconductive layer.

The above theoretical consideration of the effect of the present invention has not yet been established. To completely clarify the mechanism of liberation of trapped charges, some the further analysis and study may be required in future.

Figure 4:
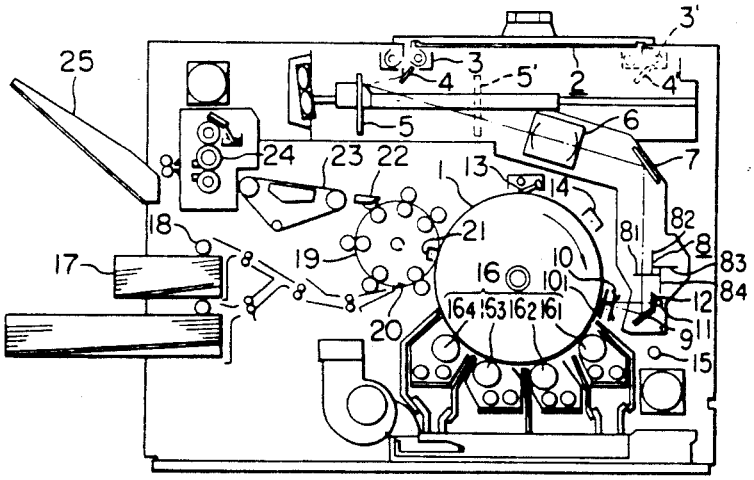
FIG. 4 is a side view of a multi-color electrophotographic apparatus showing one embodiment of the apparatus for carrying out the process according to the present invention.

FIG. 4 shows one embodiment of color copying machine for carrying out the process of the invention.

A photosensitive drum 1 includes thereon a photosensitive medium essentially comprising an electrically conductive layer, a photoconductive layer and an insulating layer as described above. An original to be copied is laid on an original table 2 made of glass and it is illuminated with a lamp 3. Scanning mirrors 4 and 5 move synchronously with the rotation of the drum 1 to scan the original. The illumination lamp 3 moves also together with the scanning mirrors and when the mirrors 4 and 5 reach the positions 4' and 5' respectively, the lamp 3 comes to the position 3'.

The scanned light image of the original is projected onto the surface of the photosensitive medium through optical system 6, mirror 7, color separation means 8 and mirror 9 and further through a discharger simultaneous with exposure 10. Color separation means 8 is disposed for change-over to selectively use any one of blue filter $8_1$, green filter $8_2$, red filter $8_3$ and ND filter $8_4$.

Adjacent to the mirror 9, there is disposed a light source 11 which may be miniature tungsten lamps. The light source is so set as to be put on with a predetermined exposure every time of color separation exposure. Light emitted from the light source 11 is projected onto the photosensitive drum 1 uniformly through a filter 12 which transmits near infrared rays. The uniform exposure with near infrared light is effected simultaneously with the exposure of the original light image to the photosensitive drum. The necessary control of exposure by the near infrared light may be advantageously effected by controlling the voltage applied to the lamp used as the light source 11.

Figure 5:
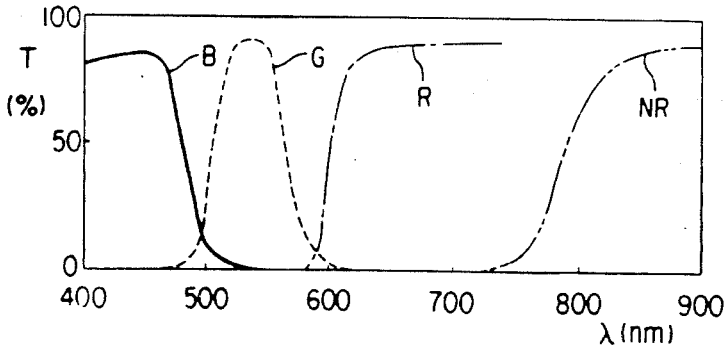
FIG. 5 shows characteristic curves of filters used for color separation image-wise exposure and near infrared light exposure according to the invention.

Spectral transmissivity characteristics of each color filter used in color separation exposure and the near infrared light transmissive filter are illustrated in FIG. 5 wherein solid line curve B is for blue filter, broken line curve G for green filter, one point chain line curve B for red filter and two point chain line curve NR is for near infrared filter.

Prior to the above described image-wise exposure and uniform near infrared exposure, the surface of the photosensitive drum 1 is made clean with a blade cleaner 13 and then uniformly charged with a primary charger 14 so as to give the photosensitive medium a uniform surface potential. To this surface of the photosensitive medium the above described exposure with original light image as well as with the near infrared light is effected and also AC discharging is effected with the discharger simultaneous with exposure 10. After that, it is subjected to a whole surface exposure by a whole surface exposure light source 15. Now, there is formed an electrostatic latent image of high contrast on the photosensitive medium surface.

Development of the latent image is carried out at the developing station where a developing device 16 is provided which comprises developer units for feeding necessary color developers, that is, unit $16_1$ for yellow, $16_2$ for magenta, $16_3$ for cyan and $16_4$ for black.

Developed image is transferred onto a transfer material 17 which is fed to the transfer unit 19 by a feeding roller 18. The transfer unit 19 has a gripper 20 with which the fore-edge of the transfer material 17 is gripped to hold the transfer material in the position. A corona discharge is applied to the transfer material in a form of sheet from its backside by means of a corona discharger for transferring 21 and the developed image is transferred onto the transfer sheet from the photosensitive medium. In case of monochromatic copy, the transfer sheet 17 is separated from the transfer unit by the action of a separating pawl 22 immediately after transferring. On the contrary, in case of multi-color reproduction, the gripper 20 of the transfer unit is not released and the separating pawl 21 is not actuated before two or three color component images to be reproduced have been transferred onto the transfer material. During this step of transferring, the transfer unit 19 continues holding the transfer material in the position. In either case, after separation the transfer material 17 is transported to a heat fixing roller 24 by means of a conveyor belt 23 and the developed image on the transfer material is heat-fixed thereby.

After completion of fixing, the transfer material is discharged onto a sheet discharge tray. On the other hand, after transferring, the photosensitive drum 1 introduced into the cleaning station where developer remained on the surface thereof is cleaned off and the drum now becomes ready for the next cycle of copying operation.

To assist in better understanding of the invention, Examples are given as follows:

EXAMPLE 1

A photosensitive plate of three-layer structure as described above was prepared according to the following prescription:

| | |
|---|---|
| Microcrystalline CdS (activated by copper) | 100 g |
| Vinyl chloride-vinyl acetate copolymer | 10 g |
| Methyl ethyl ketone | 20 g |
| Methyl isobutyl ketone | 30 g |

These ingredients were uniformly dispersed to form a photosensitive liquid dispersion. After drying, the dispersion was coated onto an aluminium foil so as to form a coating film 40μ thick and then it was dried. Onto the coating film there was applied a polyester film 25μ thick and bonded together using a bonding agent of epoxy resin so that a photosensitive plate of three-layer structure was obtained.

The photosensitive plate was sticked on a metal drum using a double side adhesive tape to form a photosensitive drum. The photosensitive tape made in this manner is mounted to the color copying machine illustrated in FIG. 4 to carry out the process of the invention.

Primary charging was initially carried out to the photosensitive drum by applying a voltage of ⊕6.3 KV and then it was exposed to the light image of an original while discharing with AC 6.5 KV applied voltage. As the original, Kodak Gray Scale was used which was illuminated by a halogen lamp and the exposure was effected through a blue filter B (interference filter) which exhibited a spectral transmissivity distribution as shown in FIG. 5, and with maximum exposure of 6 $\mu J/cm^2$. Thereafter, the whole surface of the photosensitive drum was exposed to white light. In this manner, an electrostatic latent image was formed. As a control, no exposure with near infrared light was conducted in this run. The potential of latent image on the photosensitive drum was measured with an electrometer.

In the same manner, exposures were carried out through a green filter G (interference filter) as shown in FIG. 5 with maximum exposure of 5 $\mu J/cm^2$ and also through a red filter R (Kodak Wratten No. 25) with maximum exposure of 9 $\mu J/cm^2$ respectively, and potentials of the resultant latent images on the photosensitive drum were measured in the same manner respectively. The results of the measurements are given in the following Table 1.

TABLE 1

| Color separation filter | Density of original 0.10 | 0.50 | 1.00 | 1.50 |
|---|---|---|---|---|
| Blue | 30 V | 250 V | 440 V | 480 V |
| Green | −30 | 220 | 430 | 470 |
| Red | −50 | 200 | 430 | 460 |

The above described electrostatic latent image forming process was repeated with the exception that each the color separation exposure was accompanied with near infrared light exposure to control the gradient of the formed latent image according to the invention.

To this end, four miniature tungsten lamps of 24 V, 0.5 W were provided behind the color separation filter along the axis of the photosensitive drum so as to uniformly expose the surface of the drum with the light through a near infrared ray transmissive filter NR (Kodak Wratten No. 87) having characteristics as shown in FIG. 5.

With this arrangement, a uniform exposure light of near infrared was applied to the photosensitive drum surface in an amount of 14 $\mu J/cm^2$ (20 V put on) at the time of blue color separation exposure, with 10 $\mu J/cm^2$ (18 V put on) for green and with 7 $\mu J/cm^2$ (16 V put on) for red respectively. The potential of electrostatic latent image then formed was measured every time.

Latent image potentials found are given in the following Table 2. In the table, difference in potential from the corresponding value of control (Table 1) is also shown in Bracket ( ).

TABLE 2

| Color separation filter | Density of original 0.10 | 0.50 | 1.00 | 1.50 |
|---|---|---|---|---|
| Blue | −50 V (Δ80) | 180 V (Δ70) | 400 V (Δ40) | 450 V (Δ30) |
| Green | −60 (Δ30) | 170 (Δ50) | 390 (Δ40) | 440 (Δ30) |
| Red | −60 (Δ10) | 180 (Δ20) | 400 (Δ30) | 440 (Δ20) |

From the above Table 2, it is obviously seen that according to the invention a great reduction of latent image potential is attained at the light portion for the case of light color separation exposure. Also, it is seen that for all the cases of blue-, green- and red-color separation exposure, the potential on the area from dark portion (density of original: 1.00 and 0.50) to light portion (density of original: 0.10) is reduced to an extent equal to or more than the reduction of potential at the darkest portion (density of original: 1.50). As a result, a conformity of all the three latent image potential characteristics relating to blue-, green- and red-color components is obtained and the linearity of the characteristic curves is greatly improved.

Figure 6:
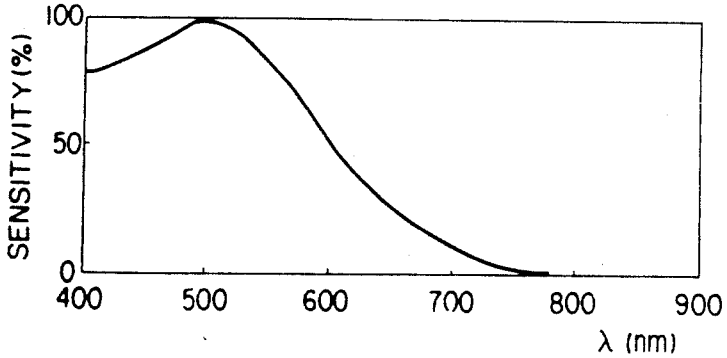
FIG. 6 is a sensitivity curve of one embodiment of a photosensitive medium used in the invention.

FIG. 6 shows the distribution of spectral sensitivity of the photosensitive drum used in this example. The abscissa is wavelength and the ordinate is specific sensitivity. FIG. 6 indicates that the photosensitive drum has almost no sensitivity to the near infrared range of light used in the above experiments.

To further illustrate the effect of the invention, another experiment was conducted. In this experiment, the above mentioned uniform exposure with near infrared light was omitted and instead the amount of color separation exposure was increased upto the extent at which the latent image potential for density of original: 0.10 could be obtained. It was found that the increments of exposure light required therefor were 80% for blue color exposure, 30% for green and 10% for red. Furthermore, it was observed that the latent image potential characteristic curve of blue exposure exhibited such tendency that with the increase of exposure the potential on the area extending from the dark portion to the light portion was reduced as a whole. This tendency was also observed for green exposure and for red exposure although it became smaller and smaller in this order. It was substantially impossible to obtain a conformity of three characteristic curves of blue-, green- and red-components only by controlling the amount of exposure in each the color separation exposure.

Each of the individual color component latent images formed under the conditions shown in Table 2 was then developed with colored developing agents employing yellow developer for blue component, magenta for green component and cyan for red component respectively and developed individual images were overlaid on each other on a transfer sheet. Thereafter, fixing was effected thereon. In this manner, a color copy was produced which was very good in color balance and excellent in reproduction of gradient.

All of the colored developing agents used in this example had almost the same $\tau$ value of image density—latent image potential characteristic curve to each other. Therefore, in the above described example, adjustments of color separation exposures were so made as to give the same electrostatic latent image characteristic to the individual color component latent images. However, there may occur the case where these colored developing agents are different from each other in $\tau$-characteristic for some reason such as coloring or deterioration. In such a case, the amount of exposure with near infrared rays must be suitably changed every time of individual color separation exposure according as the characteristic of the developing agent so as to make the potential characteristics of the formed individual component latent images different from each other. In this manner, balance in color after developing can be adjusted properly even when the developing agents then used are different from each other in $\tau$-characteristic.

As will be understood from the foregoing, according to the invention it becomes possible to well control $\tau$ value of electrostatic latent image formed and also to reproduce image excellent in gradient. When the present invention is used for color reproduction, a color image of good balance in color can be obtained by controlling $\tau$ value of each individual electrostatic latent image corresponding to each color component image.

Apparatus according to the invention is simple in structure. It is only required to additionally provide a source of near infrared light in the light path of exposure light for control $\tau$ value of electrostatic latent images to be formed in the apparatus.

While there has been described a preferred form of the invention, obviously various modifications and variations are possible in light of the above teachings within the scope of the appended claims.

What is claimed is:

1. An electrophotographic apparatus for sequentially exposing a repeatedly usable photosensitive member to light images of different color components to form corresponding latent images for formation of a resultant multicolor image, said apparatus comprising:

means for exposing at least a portion of said photosensitive member to light images of predetermined color components; and means for uniformly exposing said portion of said photosensitive member to near infrared light, substantially simultaneously with the exposure of said portion by said light image exposure means, wherein said uniform exposure light is mainly in a long wavelength range which is outside the wavelength to which said photosensitive member is principally sensitive.

2. An electrophotographic apparatus as claimed in claim 1, wherein said near infrared exposing means irradiates light of wavelength range above 700 nm to said photosensitive member.

3. An electrophotographic apparatus as claimed in claim 1, wherein said apparatus further comprises developing means for feeding a given color developing agent.

4. An electrophotographic apparatus as claimed in claim 1, wherein said light image exposing means comprises a filter member for exposing said photosensitive member to light of predetermined wavelength range.

5. An electrophotographic apparatus including a plurality of developing units for developers of different colors, respectively, comprising:

a photosensitive member mainly consisting of an insulating layer, a photoconductive layer and a conductive layer;

means for exposing at least a portion of said photosensitive member to light images of predetermined color components; and means for uniformly exposing said portion of said photosensitive member to near infrared light, substantially simultaneously with the exposure of said portion by said light image exposure means, wherein said uniform exposure light is mainly in a long wavelength range which is outside the wavelength range to which said photosensitive member is principally sensitive.

6. An electrophotographic apparatus as claimed in claim 5, wherein said near infrared light exposing means irradiates light of wavelength range above 700 nm to said photosensitive member.

7. An electrophotographic apparatus as claimed in claim 6, wherein said near infrared light exposing means comprises a near infrared light transmissive filter.

8. An electrophotographic apparatus as claimed in claim 5, wherein said light image exposing means comprises a plural number of filter members each adapted for exposing said photosensitive medium to light of a different wavelength range, respectively.

9. An electrophotographic apparatus as claimed in claim 5, wherein said electrostatic latent image forming means comprises a primary corona discharging device, a secondary corona discharging device and a light source for whole surface exposure.

10. An electrophotographic apparatus as claimed in claim 9, wherein the polarity of voltage applied to said secondary corona discharging device is opposite to that of the voltage applied to said primary corona discharging device.

11. An electrophotographic apparatus as claimed in claim 9, wherein an AC voltage is applied to said secondary corona discharging device.

12. An electrophotographic apparatus as claimed in claim 9, wherein a direct current biased AC voltage is applied to said secondary corona discharging device.

13. An electrophotographic apparatus for sequentially exposing a repeatedly usable photosensitive member to light images of different color components to form corresonding latent images for formation of a resultant multicolor image, said apparatus comprising:

means for exposing at least a portion of said photosensitive member to light images of predetermined color components;

means for uniformly exposing said portion of said photosensitive member to near infrared light, substantially simultaneously with the exposure of said portion by said light image exposure emans, wherein said uniform exposure light is mainly in a long wavelength range which is outside the wavelength range to which said photosensitive member is principally sensitive;

means for forming latent images corresponding to the light images; and plural developing means for developing the latent images with different color developers.

14. An apparatus according to claim 13, wherein said exposing means includes red, green and blue filters.

15. An electrophotographic apparatus capable of copying an original having plural color components, wherein a latent image corresponding to an original is formed on a repeatedly usable photosensitive member, comprising:

means for exposing at least a portion of said photosensitive member to a light image of the original; and means for uniformly exposing said portion of said photosensitive member to near infrared light, substantially simultaneously with the exposure of said portion by said light image exposure means, wherein said uniform exposure light is mainly in a long wavelength range which is outside the wavelength range to which photosensitive member is principally sensitive.

* * * * *

UNITED STATES PATENT AND TRADEMARK OFFICE

CERTIFICATE OF CORRECTION

PATENT NO. : 4,504,137

DATED : March 12, 1985

INVENTOR(S) : TAKAO AOKI, ET AL.

It is certified that error appears in the above-identified patent and that said Letters Patent is hereby corrected as shown below:

COLUMN 1

Line 12, after "to" insert --a--.

Line 14, after "to" insert --an--.

Line 56, after "that" insert --,-- after "of" (first occurrence) insert --a--.

COLUMN 2

Line 63, "allowed to obtain" should read --obtained--.

COLUMN 3

Line 25, after "provide" insert --an--.

Line 31, "control" should read --controls--.

Line 33, after "provide" insert --an--

Line 46, "object" should read --objects--.

Line 60, after "is" (both occurrences) insert --the--.

COLUMN 4

Line 26, "of" should --or a--.

Line 27, after "also" insert --a--.

COLUMN 5

Line 12, "on" should read --an--.

Line 14, delete "of".

Line 19, after "particular" insert --,--.

Line 20, after "medium" delete ",".

UNITED STATES PATENT AND TRADEMARK OFFICE

CERTIFICATE OF CORRECTION

PATENT NO. : 4,504,137

DATED : March 12, 1985

INVENTOR(S) : TAKAO AOKI, ET AL.

It is certified that error appears in the above-identified patent and that said Letters Patent is hereby corrected as shown below:

COLUMN 6

Line 41, "ight" should read --light--.

Line 47, "can not" should read --cannot--.

"only" should read --except--.

Line 51, "becomes almost disappeared" should read --almost disappears--.

COLUMN 7

Line 3, delete "of" second occurrence.

Line 13, delete "the".

Line 15, after "of" insert --a--.

COLUMN 8

Line 12, delete "form of".

Line 36, after "understanding" delete ", of".

Line 58, "sticked" should read --attached--.

COLUMN 9

Line 29, delete "the".

COLUMN 10

Line 16, "upto" should read --to--.

Line 31, delete "the".

Lines 36 and 37, before and after "respectively" insert --,--.

UNITED STATES PATENT AND TRADEMARK OFFICE

CERTIFICATE OF CORRECTION

PATENT NO. : 4,504,137

DATED : March 12, 1985

INVENTOR(S) : TAKAO AOKI, ET AL.

It is certified that error appears in the above-identified patent and that said Letters Patent is hereby corrected as shown below:

COLUMN 10

Line 54, "as" should read --to--.

Line 62, "well control" should read --control the--.

Line 64, "image" should read --images--.

Signed and Sealed this

*Thirty-first* Day of *December 1985*

[SEAL]

*Attest:*

DONALD J. QUIGG

*Attesting Officer*

*Commissioner of Patents and Trademarks*